US006419003B1

(12) United States Patent
Nilsson et al.

(10) Patent No.: US 6,419,003 B1
(45) Date of Patent: Jul. 16, 2002

(54) COOLING TIME CONTROL

(75) Inventors: Soren Nilsson, Gothenburg; Eric Sjodahl, Alingsas, both of (SE)

(73) Assignee: LMI Technologies Inc. (CA)

( * ) Notice: Subject to any disclaimer, the term of this patent is extended or adjusted under 35 U.S.C. 154(b) by 0 days.

(21) Appl. No.: 09/588,498

(22) Filed: Jun. 7, 2000

Related U.S. Application Data

(60) Provisional application No. 60/138,090, filed on Jun. 8, 1999.

(51) Int. Cl.[7] ..... B22D 46/00; B22C 19/04

(52) U.S. Cl. ..... 164/4.1; 164/458; 164/154.1; 164/154.2

(58) Field of Search ..... 164/154.2, 154.1, 164/4.1, 456, 323, 324

(56) References Cited

U.S. PATENT DOCUMENTS

| | | | | | |
|---|---|---|---|---|---|
| 4,112,999 | A | * | 9/1978 | Gasper | 164/154 |
| 4,724,894 | A | * | 2/1988 | Sjodahl | 164/457 |
| 6,073,678 | A | * | 6/2000 | Garza-Ondarza et al. | 164/130 |
| 6,145,577 | A | * | 11/2000 | Hunter et al. | 164/323 |

FOREIGN PATENT DOCUMENTS

WO WO-97/20651 * 6/1997

* cited by examiner

*Primary Examiner*—M. Alexandra Elve
*Assistant Examiner*—Kevin McHenry
(74) *Attorney, Agent, or Firm*—Larson & Taylor, PLC

(57) ABSTRACT

Disclosed is a method for increasing production efficiency of mold lines where molten metal or other material requiring a cooling period is poured sequentially into moving molds. The invention particularly comprehends the tracking of individual molds and the individualized control of the cooling time of the molds from beginning to end of the line in the presence of random line stoppages and variant mold size.

31 Claims, 3 Drawing Sheets

MOLDING LINE LAYOUT:

COOLING TIME CONTROL

This application claims benefit of U.S. Provisional Application No. 60/138,090 filed Jun. 8, 1999.

Cross references to related co-pending applications by the inventors—WO 97/20651.

Federally sponsored R and D statement—not applicable.

Microfiche Appendix—not applicable.

FIELD OF THE INVENTION

Disclosed is a method for increasing production efficiency of mold lines where molten metal or other material requiring a cooling period is poured sequentially into moving molds. The invention particularly comprehends the tracking of individual molds and the individualized control of the cooling time of the molds from beginning to end of the line in the presence of random line stoppages and variant mold size.

BACKGROUND OF THE INVENTION

Automatically controlled pouring lines for molten metal in foundries re discussed in patents and applications by the inventors such as U.S. Pat. No. 4,724,894 aid WO 97/20651, of which this application is a continuation in part.

To get proper quality of castings made in a typical "DISAMATIC" or other vertical parted molding line, it's essential that the cast iron parts remain in their sand mold for a certain time period based on the cross section of parts plus the iron/sand ratio. This cooling time is typically 30–50 minutes.

However, many foundries operating high production molding lines of this type, can't utilize the potential line speed made possible by the ability of the mole making machine to create the molds, because of inadequate cooling time provided by the short lengths of cooling sections caused by plant size constraints and other factors. They must slow down the production speed (MPH, or molds per hour) in order to get sufficient cooling time.

For example, let us take the case of a vertical ported molding line containing a molding machine, (for example by Disamatic) whose potential speed is 400 molds per hour. (see also referenced co-pending application WO 97120651 of the inventors incorporated herein by reference) Assuming, as is often the case, a length of cooling section in the line of 40 m, and that each mold size is 250 mm. in the direction of line flow (noting that mold size varies, and is measured either by the mold making machine, or automated pouring machine, if present). Required cooling time for this particular model is assumed to be 36 minutes. This then gives a resultant average rate mold speed of 240 parts per hour, so limited in order to not let any mold get out of the cooling sections until the required time have expired.

The mold making machine cycle time has thus been slowed from a potential of 400 to 240 which only is 60 percent utilization of the machine. The solution of this problem is to extend the cooling section but this is often impossible or impractical due to economic issues or physical limits.

In addition, the above example is calculated assuming the production line has no stoppages or waiting situations during production. Typically however, a foundry has waiting times of around 6–10 minutes per hour caused by pattern changes (used to create the molds), waiting for iron & sand, equipment failure or whatever the reason might be. So instead of making 240 good molds and parts therefore, they only sake 200 due to a down time of 10 minutes.

There is no prior art known to the inventors addressed to solving this additional problem of lost production due to stoppages or other waiting time delays in such lines. Nor is there any present method to account individually for variation in mold size in so far as cooling time is concerned.

SUMMARY OF THE INVENTION

An automated pouring system, such as the "LaserPour" system which has evolved from that described in the referenced patents above and often used today to control pouring of metal, is designed to determine information on each mold produced in the molding machine to manage the positioning feature of the pouring vessel so as to fill the pouring cup properly with the molten metal stream. One piece of information obtained is mold size (although in certain modern molding lines, this information is also available from the mold making machine). Mold size can vary, particularly in the line direction (length direction), due to a variety of factors, including compressibility variation in the sand making up a mold, as is often used in iron foundries. By storing data such as mold size and pour height (if different) on all molds in a buffer, the entire mold stack (i.e., group of sequentially poured molds) can be monitored from the time it was poured until it reaches the end of cooling section. The LaserPour system, for example, by utilizing the invention herein, can control the cycle time of the molding machine preceding the pouring station by delaying the release signal for next index.

To produce 240 molds per hour the pouring machine cycle time should average 15 seconds. As noted above, a stop of the production of even 5 minutes results in a loss of 20 molds. When the production starts again the Cooling Time Control function of the invention will increase the line speed to the maximum until the 5 Minutes stopping time (during which cooling was however occurring) has been recovered, then it will go back to nominal 240 MPH again, providing that a second stop occurs within the stipulated cooling time of the mold. This is done with full control so no mold will leave the cooling section prior to the required cooling time—an added quality assurance as well. If however a mold is to be pushed out without having accumulated the stipulated cooling time, the system will hold the mold line.

Over all, we have found the productivity increase on the line is generally few percent depending on the mix of parts produced with various required cooling times. This is very important, as every percent increase in production of such lines typically represents $225,000 in increased revenue with an added profit of more than $100,000 per year.

GOALS OF THE INVENTION

It is a goal of the invention to increase productivity of typical mold lines in the foundry business—resulting in very large dollar savings even for a few percept added production.

It is a further goal of the invention to insure that quality of the castings produced can be kept within specification by individual consideration of mold cooling time.

It is a still further goal of the invention to achieve the above at economical initial and operating cost.

PREFERRED EMBODIMENTS

FIG. 1

Figure 1:
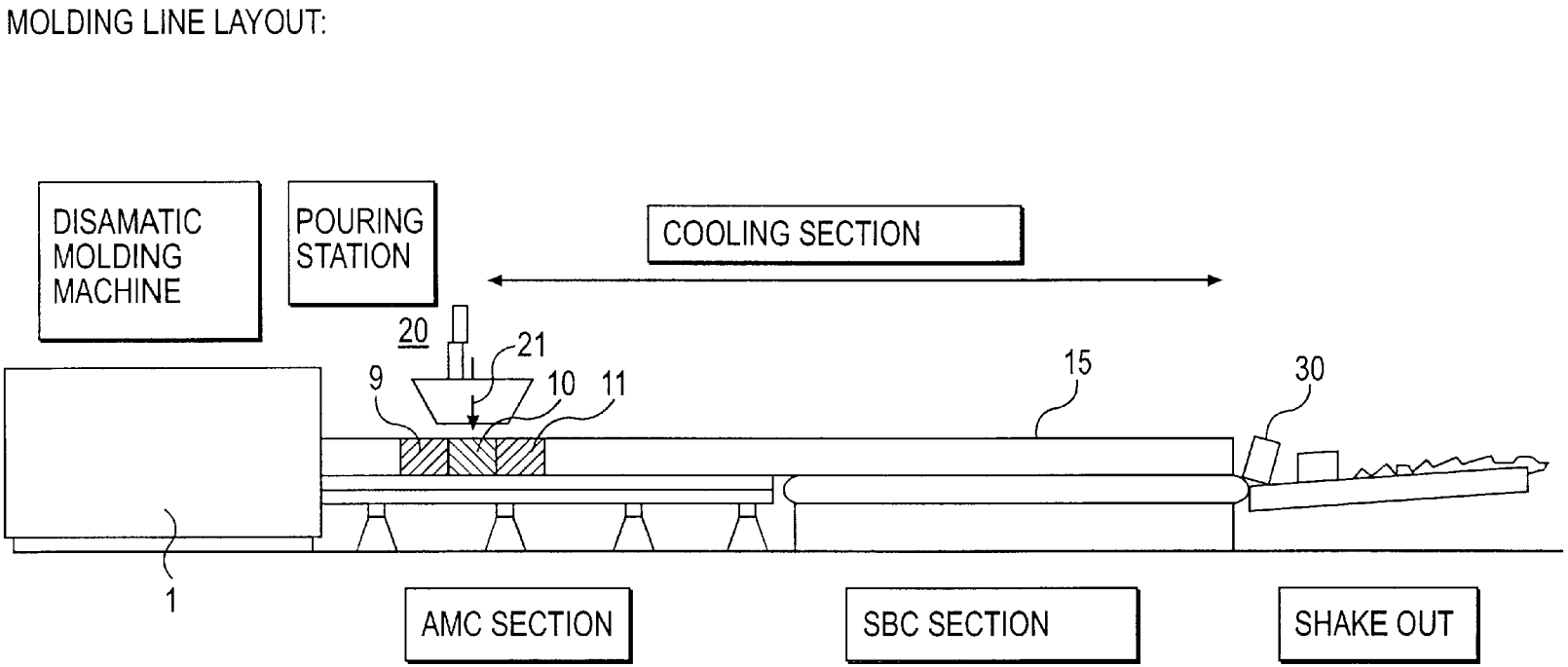
FIG. 1 illustrates a typical molding line.

Consider FIG. 1 illustrating a typical molding line. A molding machine, 1, makes molds such as 9, 10, and 11 which proceed down a conveyor line 15. A pouring device, 20, such as the LaserPour unit made by our company (described in the patents and co-pending applications above incorporated by reference), pours material, such as molten metal, 21 into each of the molds in succession. The pouring device preferably uses an electro-optical sensor, itself preferably based on laser triangulation, to determine the height of the metal being poured into the mold, so as to control the pouring operation so as to cease pouring when the mold is exactly filled, thereby eliminating material wastage and assuring quality castings. The metal height data after pouring, and data on the size of the mold which can also be electro-optically determined at this station if desired, allows the volume of material within the mold to be accurately determined—a critical parameter for determining cooling time. The molds proceed down the line, with the metal cooling in them as they go. At the end of the line, 30, each mold, with the cooled casting inside, is discharged and the pieces separated.

The controller accepts data concerning the size D_CMS in the length direction of each of the molds produced. This data is typically generated by virtue of a sensor such as 51 associated with the pouring machine, or a sensor (not shown) in the mold making machine.

FIG. 2

Figure 2:
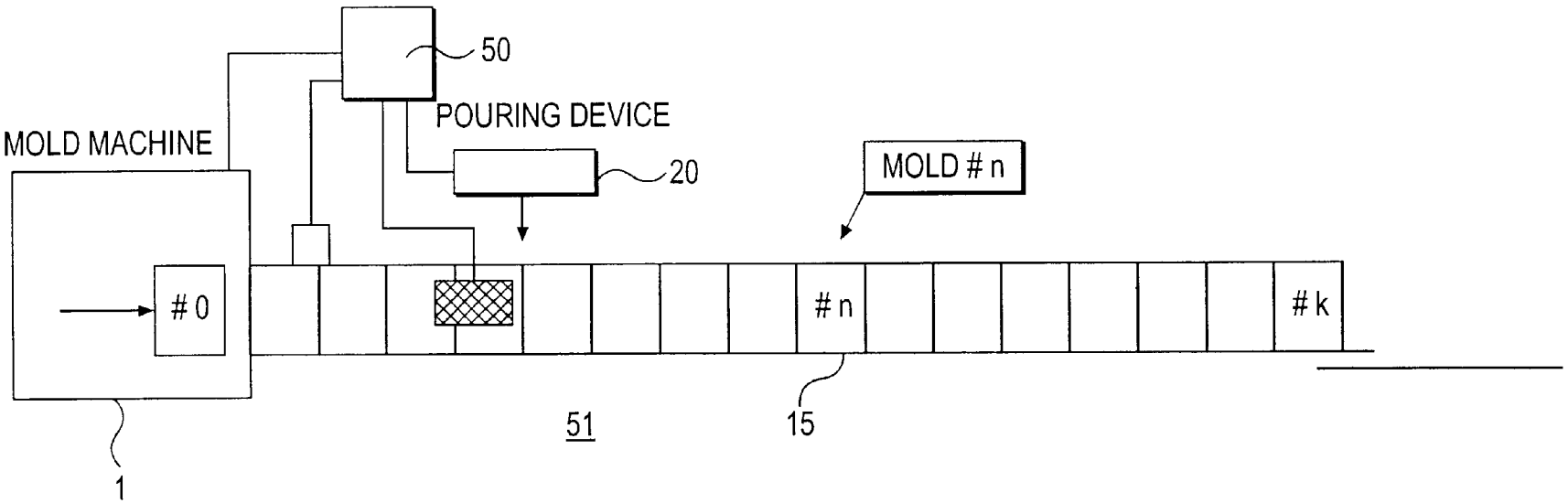
FIG. 2 illustrates further detail on such lines and the algorithms used for control.

FIG. 2 illustrates the invention in more detail with respect to the mild making machine and line control. The mold making machine 1, the conveyor 15, and the automatic pouring device 20 (if present), are all controlled by controller 50 typically including a computer which utilizes the algorithm shown below to calculate line start and stop commands in the presence of line stoppages and other production perturbations.

The controller accepts data concerning the size D_CMS in the length direction of each of the molds produced. this data is typically generated by virtue of a sensor such as 51 associated with the pouring machine, or a sensor (not shown) in the mold making machine.

The control information used by the controller is:

Given constant data for the mold line is:

Length of the cooling distance from the pouring device C_CD [mm]

Given data for each mold produced is:

| | | |
|---|---|---|
| Mold size (of mold #0) | D_CMS | [mm] |
| Line Speed | D_LS | [# Molds/s] |

Given data for each mold poured is:

| | | |
|---|---|---|
| Minimum allowed cooling time | C_MACT | [s] |
| Time when mold was poured | D_TWP | [s] |

Data that can be calculated for each mold in the mold stack, at each index of the mold line:

| | | |
|---|---|---|
| Remaining Required cooling time | R_RRCT | [s] |
| R_RRCT = C_MACT-(Current time-D_TWP) | | |

-continued

| | | |
|---|---|---|
| Remaining cooling line distance | R_RCD | [mm] |
| R_RCD = C_CD-Σ {D_CMS} Accumulated mold size | | |
| Estimated remaining cooling time | R_ERCT | [s] |
| R_ERCT = R_RCD/D_CMS/D_LS | | |

After each line index the following tests and calculations for mold #n is made:

If R_RCDN is less or equal D_LS. Then if $R_RRCT_n$ is positive the mold line must be stopped for the time $R_RRCT_n$.

Line speed correction for mold #n: $R_LSC_n$ [s] $(R_RRCT_n - R_ERCT_n)/(R_RCD_n/D_CMS)$ The current line speed correction time is then equal to the maximum positive value of:

$R_LSC_1 \ldots R_LSC_k$

FIG. 3

Figure 3:
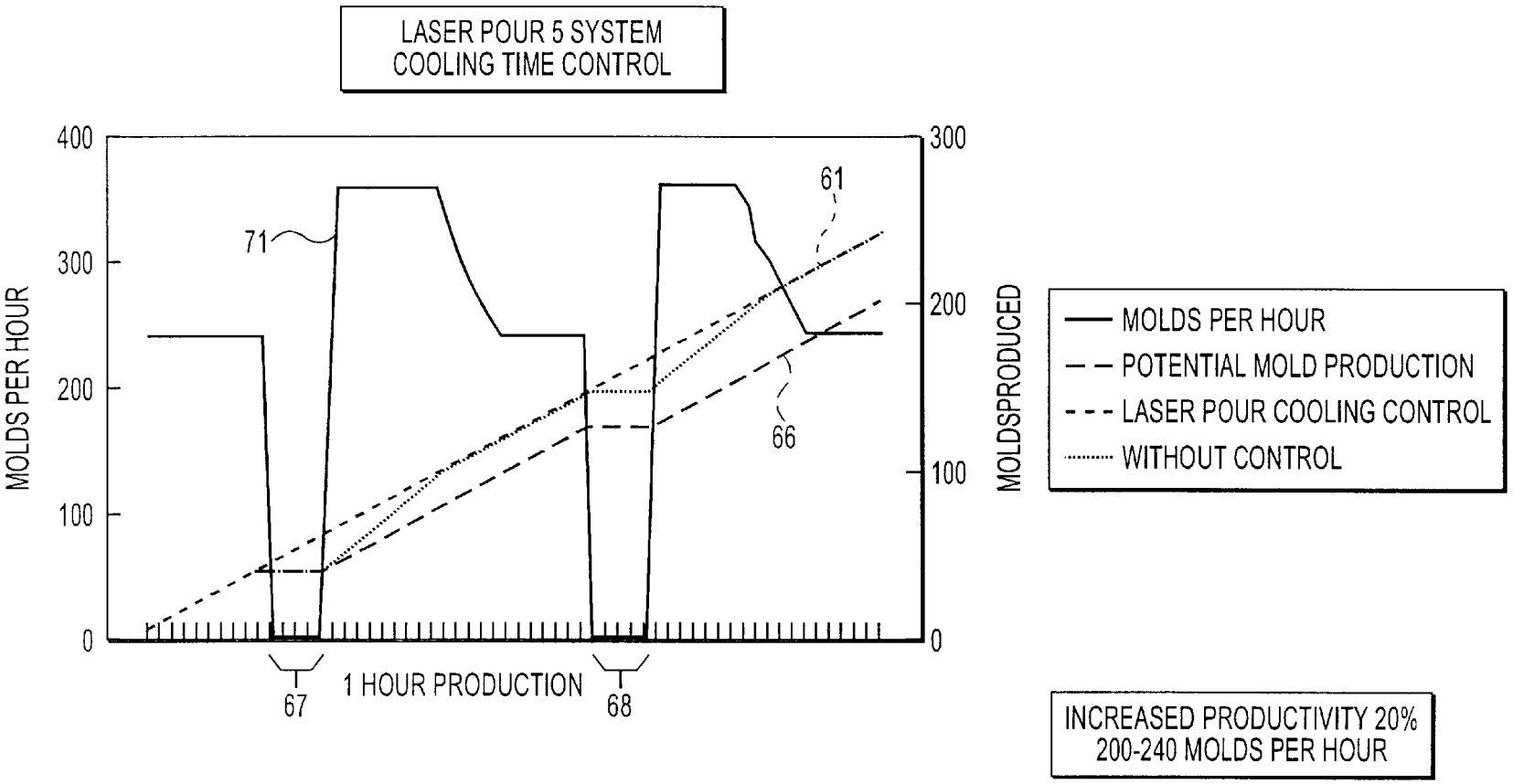
FIG. 3 illustrates a production cycle diagram of a typical line with and without benefit of the invention.

The graph of FIG. 3 shows the accumulated molds produced in one hour with and without the cooling time control feature of the invention Line 61, shows the potential number of molds produced in one hour without any stops of the molding line.

Line 66, shows the number of molds produced with a constant cycle time of 15 seconds including two stops 67 and 68, of the line of each 5 minutes for whatever reasons.

Line 71, indicates cycle time Mold per Hour (MPH), set in this case to 240 based on the required cooling time of the particular part being run. When a stop of 5 minutes occurs on the line, the LaserPour device (which may desirably incorporate the controller 50 of the instant invention) will automatically speed up the mold rate in order to catch up the lost production, with full control of the stipulated cooling time of each mold.

While described mainly for use in metal pouring applications, and particularly those pouring iron into sand molds, the invention is broadly usable wherever a medium which needs to cool is sequentially poured or other wise deposited into molds or other containers on moving lines.

What is claimed:

1. A method for controlling the production of a moving mold line, while maintaining a desired cooling time for material within a mold, comprising the steps of:

Providing information on at least one of; individual mold size, the location of an individual mold within a line, and the time an individual mold was poured, and Using said information, adjusting the speed of said line in order to compensate for changes brought about by stoppages, pattern charges, or other delays occurring in said line so as to substantially maintain a desired cooling time for said mold.

2. A method according to claim 1 wherein said material is molten metal.

3. A method according to claim 1 wherein said moving line is an indexing line.

4. A method according to claim 1 wherein said line speed is adjusted by varying the index rate of said line.

5. A method according to claim 1 wherein the length of said mold in the line direction is used to determine mold size.

6. A method according to claim 1 including the additional step of providing additional information on the volume of metal in said mold.

7. A method according to claim 1 including the additional step of providing additional information as to pour rate.

8. A method according to claim 1 wherein said information is provided for a plurality of molds within a line.

9. A method according to claim 1 wherein said information is provided for substantially all molds within a line.

10. A method according to claim 1 wherein all of said information on individual mold size, the location of an individual mold within a line, and the time an individual mold was poured is provided.

11. A method according to claim 1 wherein at least one of said mold size, mold location, or mold time of pour information is provided by a unit used to control pouring of material into said mold.

12. A method according to claim 1 wherein at least one of said mold size, mold location, or mold time of pour information is provided by sensing or otherwise determining said information at the pour station where material is poured into said mold.

13. A method according to claim 1 wherein said information is stored in a buffer.

14. A method according to claim 1 wherein said information is used to control the cycle time of a molding machine by delaying the release signal for next index.

15. A method according to claim 1 wherein said mold line is stopped if a mole reaches the end of the line without reaching a desired level of cooling time.

16. A method according to claim 1 wherein an electro-optical sensor is used to determine at least one of pour height or mold size.

17. A method for controlling the production of a moving mold time, while maintaining a desired cooling time for material within a mold, comprising the steps of sensing information concerning at least one of; individual mold size and pour height, and Using said information, adjusting the speed of said line in order to compensate for changes brought about by stoppages, pattern changes, or other delays occurring in said line so as to substantially maintain a desired cooling time for said mold.

18. A method according to claim 17 wherein said information is sensed at a pouring station.

19. A method according to claim 17 wherein said material is molten metal.

20. A method according to claim 17 wherein said moving line is an indexing line.

21. A method according to claim 17 wherein said line speed is adjusted by varying the index rate of said line.

22. A method according to claim 17 wherein the length of said mold in the line direction is used to determine mold size.

23. A method according to claim 17 including the additional step of providing additional information on the volume of metal in said mold.

24. A method according to claim 17 including the additional step of providing additional information as to pour rate.

25. A method according to claim 17 wherein said information is provided for a plurality of molds within a line.

26. A method according to claim 17 including the additional step of providing information on the location of an individual mold within a line.

27. A method according to claim 17 including the additional step of providing information on the time an individual mold was poured.

28. A method according to claim 17 wherein an electro-optical sensor is used to sense said information.

29. A method according to claim 17 wherein said production rate is controlled by delaying the release signal for the next index of a molding machine used to form said molds.

30. A method according to claim 17 wherein said mold line is stopped if a mold reaches the end of the line without reaching a desired level of cooling time.

31. A control system for moving mold lines, comprising;

Sensing means to sense information concerning at least one of individual mold size and pour height, after pouring, and Control means to adjust line speed based on said information.

* * * * *

UNITED STATES PATENT AND TRADEMARK OFFICE

CERTIFICATE OF CORRECTION

PATENT NO. : 6,419,003 B1 
DATED : July 16, 2002
INVENTOR(S) : Soren Nilsson and Eric Sjodahl It is certified that error appears in the above-identified patent and that said Letters Patent is hereby corrected as shown below:

Column 1,
Line 22, replace “re” with -- are .
Line 23, replace “aid” with -- and --.
Line 33, replace “mole” with -- mold --.
Line 42, replace “97120651” with -- 97/29651 --.
Line 66, replace “sake” with -- make --.

Column 2,
Line 44, replace “generally few” with -- generally a few --.
Line 53, replace “percept” with -- percent --.

Column 3,
Lines 24 to 28, delete the paragraph beginning “The controller…” and ending “mold making machine.”
Line 31, replace “mild” with -- mold --.

Column 4,
Line 47, insert -- after pouring -- after “and pour height”.
Line 51, replace “charges” with -- changes --.

Column 5,
Line 24, replace “mole” with -- mold --.
Line 30, replace “time” with -- line --.
Line 33, insert -- after pouring, -- after “pour height”.

Signed and Sealed this

Seventh Day of October, 2003

JAMES E. ROGAN
*Director of the United States Patent and Trademark Office*